United States Patent [19]

Andre et al.

[11] 4,130,837

[45] Dec. 19, 1978

[54] ARRANGEMENT FOR MOUNTING THE DEFLECTION SYSTEM ON THE ENVELOPE OF A COLOR-PICTURE TUBE

[75] Inventors: Wolfram Andre, Aichwald; Walter Kornaker, Esslingen-Berkheim, both of Germany

[73] Assignee: International Standard Electric Corporation, New York, N.Y.

[21] Appl. No.: 803,698

[22] Filed: Jun. 6, 1977

[30] Foreign Application Priority Data

Jun. 10, 1976 [DE] Fed. Rep. of Germany ..... 2626114

[51] Int. Cl.[2] ..... H01J 29/76

[52] U.S. Cl. ..... 358/248; 220/2.1 A

[58] Field of Search ..... 358/248; 220/2.1 A, 220/2.3 A

[56] References Cited

U.S. PATENT DOCUMENTS

| | | | |
|---|---|---|---|
| 2,354,661 | 8/1944 | Berejkoff | 358/248 |
| 3,663,751 | 5/1972 | Oberg | 358/248 |
| 3,906,419 | 9/1975 | Bissinger | 358/248 |
| 3,934,169 | 1/1976 | Groothoff | 220/2.1 A |
| 3,986,156 | 10/1976 | Smith | 358/248 |
| 4,042,961 | 8/1977 | Kraft | 358/248 |
| 4,060,836 | 11/1977 | Corbeij | 358/248 |

*Primary Examiner*—Howard W. Britton

*Attorney, Agent, or Firm*—John T. O'Halloran; Alfred C. Hill

[57] ABSTRACT

The present invention relates to providing a defined bearing surface for the deflection system of a color-picture tube and to obtain a mounting not subject to ageing. This bearing surface is molded to the cone of the tube as a glass ring or as glass ring sectors to which the deflection system is attached by means of a cap. No additional operations are required.

8 Claims, 4 Drawing Figures

ARRANGEMENT FOR MOUNTING THE DEFLECTION SYSTEM ON THE ENVELOPE OF A COLOR-PICTURE TUBE

BACKGROUND OF THE INVENTION

The present invention relates to an arrangement for mounting the deflection system of a color-picture tube of the shadow-mask type, the deflection system consisting of a ferrite toroidal core and two pairs of coils, one for horizontal and one for vertical deflection, and being connected, in a predetermined alignment with the electron-gun system and the screen, with the envelope on the side facing the screen.

Some of the modern types of color-picture tubes are supplied by the manufacturer with the deflection system assembled and adjusted. To do this, the electromagnetic deflection system is mounted on the envelope to ensure the desired accurate position relation between the magnetic deflection system, the electron-gun system, and the screen of the picture tube. As described in U.S. Pat. No. 3,566,321, the deflection system was first bonded to the envelope by filling the space between the envelope and the magnetic deflection system with a curable plastic adhesive.

Such filling involves an uneconomic consumption of adhesive, as is described in the German published patent application (DT-AS) No. 2,342,052. In addition, however, the air circulation between the envelope and the deflection system is obstructed, which results in higher temperatures and in a shorter life expectancy. Furthermore, this leads to an extremely rigid design with high internal stresses which may result in the envelope and/or the magnetic deflection system breaking in case of changes in temperature. To overcome this problem, a maximum of only 20% of the space between the envelope and the magnetic deflection system is filled with a thermoplastic, as is disclosed in the German published patent application (DT-AS) No. 2,342,052. This permits a certain air circulation, and the internal stresses are slightly reduced. Subsequent detachment of the magnetic deflection system from the envelope, however, is impossible without destroying part of the deflection system, for example.

In the case of the RCA color-picture tube A67-610X, which is used, for example, in the Blaupunkt color TV receiver FM 100/27 inches, the envelope has a ring cemented thereto which carries along its circumference four slotted tongues spaced 90° apart with the aid of which the magnetic deflection system is attached, and simultaneously adjusted, by means of screws. Thus, the magnetic deflection system can be separated from the envelope without difficulty, but adjustment is difficult because of four fastening screws must be turned at the same time.

In the case of Philips' inline color-picture tube A66500X of the 20-AX system, the deflection system is clamped to the neck of the picture tube. As the envelope there is provided a glass ring with whose side surfaces a preadjustment of the deflection system is achieved. Reference is made to a Valvo publication entitled "20 AX — Vom Konzept sum System" and issued in February 1974. The deflection system is not mounted to this centering ring.

SUMMARY OF THE INVENTION

An object of the present invention is, therefore, to provide an arrangement for mounting the deflection system of a color-picture tube on the envelope with which the deflection system is held in a defined position relative to the envelope for a long period of time.

Another object of the present invention is that the mounting as well as detachment of the deflection system to the envelope is accomplished without damage to a part and is possible without special tools and/or fixtures in a short time.

A feature of the present invention is the provision of an arrangement for mounting the deflection system of a color-picture tube to an envelope thereof on the side facing the screen comprising a glass stop collar provided in the envelope, the stop collar having a stop surface against which the deflection system rests; a plurality of connecting means carried by the stop collar and a cap engaging the connecting means and the deflection system to connect the deflection system to the envelope.

BRIEF DESCRIPTION OF THE DRAWINGS

Above-mentioned and other features and objects of this invention will become more apparent by reference to the following description taken in conjunction with the accompanying drawings, in which.

DESCRIPTION OF THE PREFERRED EMBODIMENT

Figure 1:
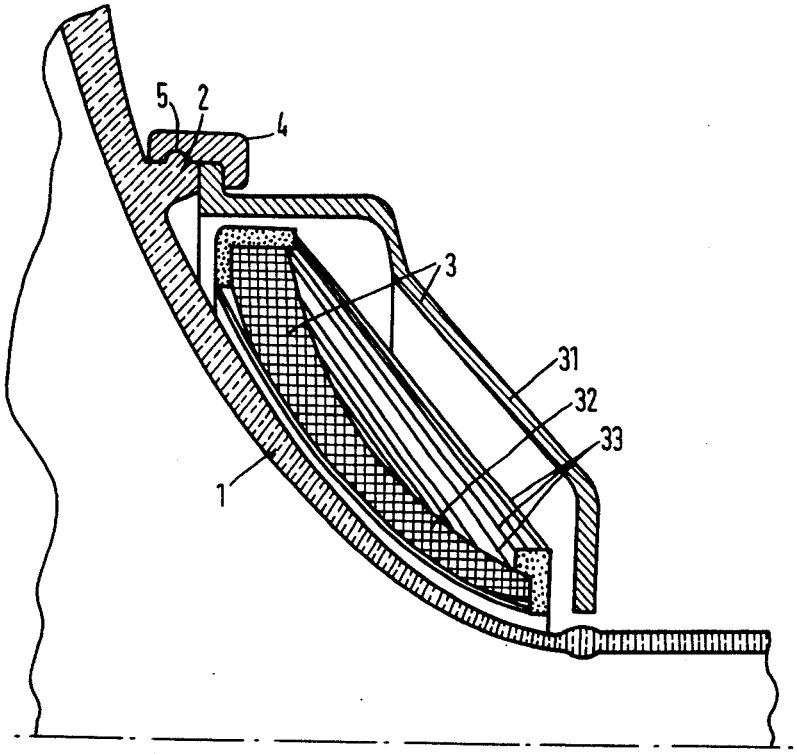
FIG. 1 is a cross-sectional view of an arrangement according to the principles of the present invention.
Figure 4:
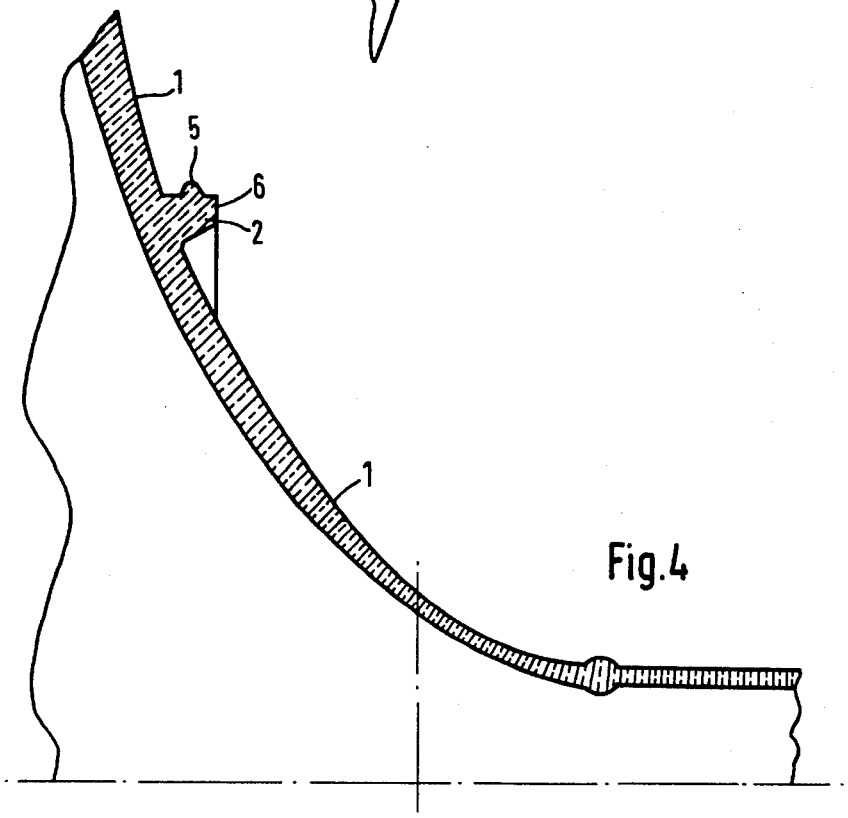
FIG. 4 is a cross-sectional view of an envelope with the stop collar according to the principles of the present invention.

FIG. 1 shows a cross-sectional view through an arrangement according to the principles of the present invention for mounting the deflection system of a color-picture tube on the envelope. The moulded-glass envelope 1 includes a stop collar 2 made of glass. A deflection system 3 (highly simplified), is connected with stop collar 2 by cap 4. Of the deflection system 3, only the outer cover 31 and the toroidal-coil unit, which is located inside cover 31 and consists, as usual, of a bell-frustum-shaped ferrite core 32 with the toroidal coils 33 wound thereon, are shown. The devices for positioning the toroidal-coil unit, which are located between these two parts, are not shown. They determine the position of the toroidal coil unit relative to the cover 31, but their special design is irrelevant for the present mounting arrangment. The section of FIG. 4 shows only the envelope with the stop collar 2 of glass.

The stop collar 2 may be moulded onto the envelope 1 during manufacture, but it may also be fabricated separately and joined to the envelope 1 by means of a solder glass. In the first case, it may serve as a reference for the assembly of the picture tube; this also ensures that the stop collar forms an accurately aligned support for the deflection system 3. In the second case, the stop collar may be joined to the envelope simultaneously with the screen using one and the same gauge, whereby, in turn, a high positional accuracy of the stop surfaces relative to the mechanical and electrical tube axis is achieved.

Figure 2:
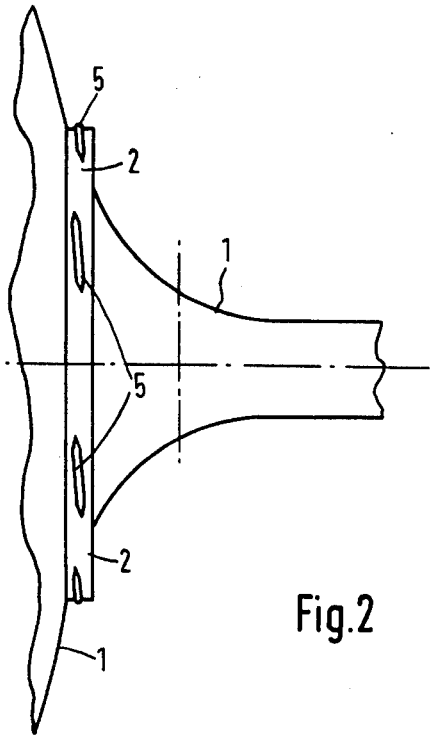
FIG. 2 is a side view of the envelope with the multiple-thread stop collar according to the principles of the present invention.
Figure 3:
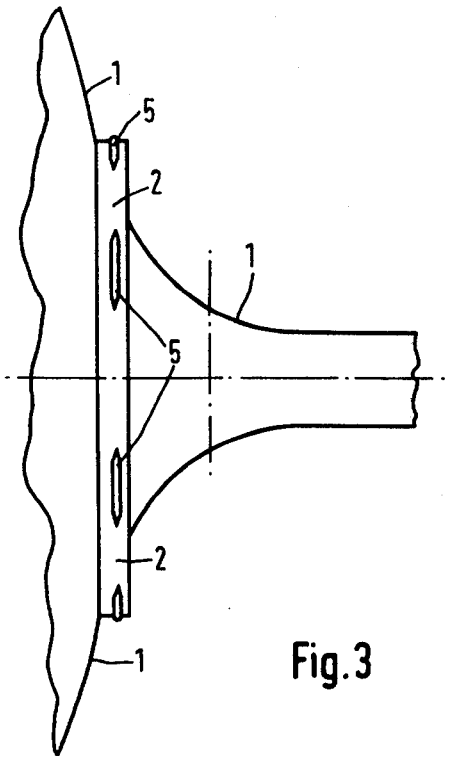
FIG. 3 is a side view of the envelope with the stop collar according to the principles of the present invention for a bayonet joint.

The deflection system 3 is connected with the stop collar 2 by means of a cap 4. The cap 4 is made of a suitable plastic material. The connection with the stop collar may be a screw connection, a bayonet joint, or a clamp connection. For a screw connection, the stop collar 2 may be provided with thread ridges 5 as shown in FIG. 2 which engage with corresponding thread grooves of the cap 4, which thus becomes a cap nut. To ensure that the cap can be tightened and lossened quickly, the thread may be designed like the thread of an objective mount. Such a screw joint is indicated in FIG. 1. A modification of this embodiment is shown in FIG. 3. Here the ridges 5 have no pitch, but extend parallel to the edge of the ring. Thus the connection may be designed as a bayonet joint or as a clamp connection. In the case of the bayonet joint, clamping dogs engage behind the ridges and thus pull the deflection system 3 against the stop surface 6 by means of the rim of the cap. In the case of a clamp connection, the cap 4 is made of soft plastic and converges slightly at its opening. When it is pressed over the ridges 5, it tries to force these ridges towards the point closest to the mounting flange and thus pulls the deflection system 3 against the stop surface 6. Such clamp connections are used, for example, with bottle caps for closing crown cork bottles which have been opened. Another possibility is to mould to the cap 4 resilient tongues which engage behind the ridges 5 of the ring 2 and thus brace the deflection system 3 and the stop collar 2 against one another. In this case, the cap may be made of the same material as the cover 31 of the deflection system 3. As in the other cases where the cap and the cover may be made of the same material, the cap 4 and the cover 31 may be of one-piece construction. It is also possible, however, to join the two parts with adhesives, particularly if they are made of different materials. All these possibilities allow a deflection system to be quickly and reliably mounted on the envelope. In all cases, detachment and reattachment are possible without damage to or destruction of any parts. Since there can be no change in the shape or position of the stop collar of glass due to ageing or flowing of an adhesive, any shifting of the deflection system is impossible. The stop collar 2 may be designed as a closed ring, but it may also consist of a number of individual circular-ring sectors.

While we have described above the principles of our invention in connection with specific apparatus it is to be clearly understood that this description is made only by way of example and not as a limitation to the scope of our invention as set forth in the objects thereof and the accompanying claims.

We claim:

1. An arrangement for mounting the deflection system of a color picture tube to an envelope thereof on the side facing the screen comprising:

a glass stop collar provided in said envelope, said stop collar having a stop surface against which said deflection system rests;

a plurality of connecting means carried by said stop collar; and a cap engaging said connecting means and said deflection system to connect said deflection system to said envelope.

2. An arrangement according to claim 1, wherein said stop collar is a ring formed in said envelope.

3. An arrangement according to claim 1, wherein said cap is permanently connected to a cover of said deflection system.

4. An arrangement according to claim 1, wherein said cap is a clamp cap and urges said deflection system against said stop surface.

5. An arrangement according to claim 1, wherein said stop collar is molded in said envelope during the manufacture of said envelope.

6. An arrangement according to claim 1, wherein said stop collar has a plurality of thread ridges thereon, and said deflection system is connected to said stop collar by said plurality of thread ridges and said cap in the form of a cap nut.

7. An arrangement according to claim 6, wherein said cap is permanently connected to a cover of said deflection system.

8. An arrangement according to claim 6, wherein said plurality of thread ridges are formed like the thread of an objective mount.

* * * * *